US005250995A

United States Patent [19]

Fare'

[11] Patent Number: 5,250,995

[45] Date of Patent: Oct. 5, 1993

[54] ELECTROPHOTOGRAPHIC DEVELOPING APPARATUS HAVING IMAGE QUALITY IMPROVING DEVICES

[75] Inventor: Carlo Fare', Limito, Italy

[73] Assignee: Bull HN Information Systems Italia, S.p.A., Phoenix, Ariz.

[21] Appl. No.: 731,690

[22] Filed: Jul. 17, 1991

[30] Foreign Application Priority Data

Jul. 20, 1990 [EP] European Pat. Off. ..... 90830342.3

[51] Int. Cl.[5] ..... G03G 15/14

[52] U.S. Cl. ..... 355/273; 355/246; 355/221

[58] Field of Search ..... 355/246, 245, 274, 273, 355/276, 265, 221, 222

[56] References Cited

U.S. PATENT DOCUMENTS

| | | | |
|---|---|---|---|
| 4,039,257 | 8/1977 | Connolly | 355/273 |
| 4,348,098 | 9/1982 | Koizumi | 355/274 |
| 4,984,022 | 6/1991 | Matsushita et al. | 355/246 |

FOREIGN PATENT DOCUMENTS

| | | | |
|---|---|---|---|
| 56-50340 | 5/1981 | Japan | 355/274 |
| 59-31982 | 2/1984 | Japan | 355/273 |
| 60-95471 | 5/1985 | Japan | 355/274 |
| 60-241068 | 11/1985 | Japan . | |

OTHER PUBLICATIONS

Koehler et al, "Field Enhancement of Pretransfer Discharge", May 1976, p. 13, vol. 1, No. 5.

*Primary Examiner*—A. T. Grimley
*Assistant Examiner*—Shuk Y. Lee
*Attorney, Agent, or Firm*—John S. Solakian; James H. Phillips

[57] ABSTRACT

Electrophotographic developing apparatus including a carrier of latent image formed on a photoconductive layer superposed to a conductive layer, a carrier of developing material juxtaposed to the latent image carrier at a developing zone for transferring the developing material on the photoconductive layer in a configuration corresponding to the latent image and a transfer station in which a printing support is brought in contact with the photoconductive layer for transferring the developing material from the photoconductive layer to the printing support, the distribution of the developing material on the photoconductive layer being enhanced by subjecting the photoconductive layer, in a zone extending between the developing zone and the transfer station, to an alternating electrical field which enables migration of developing material particles from the outside of the latent image to the inside of the latent image.

5 Claims, 3 Drawing Sheets

FIG. 1
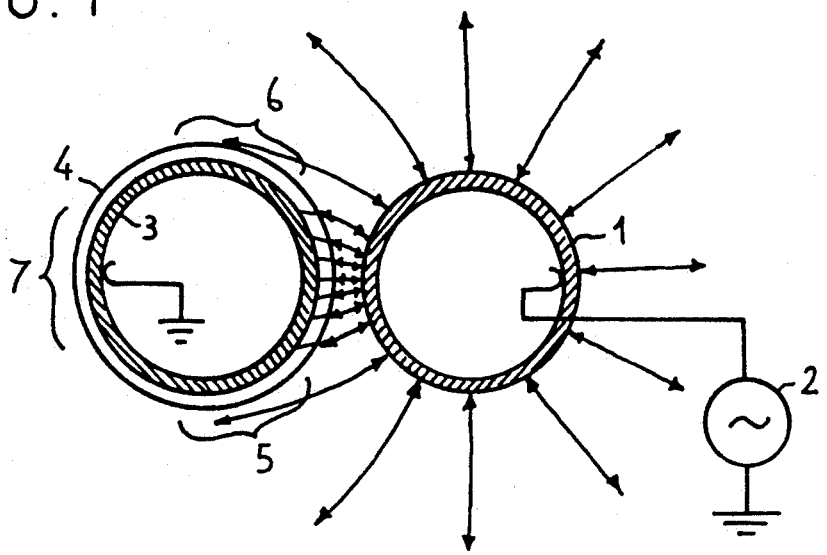
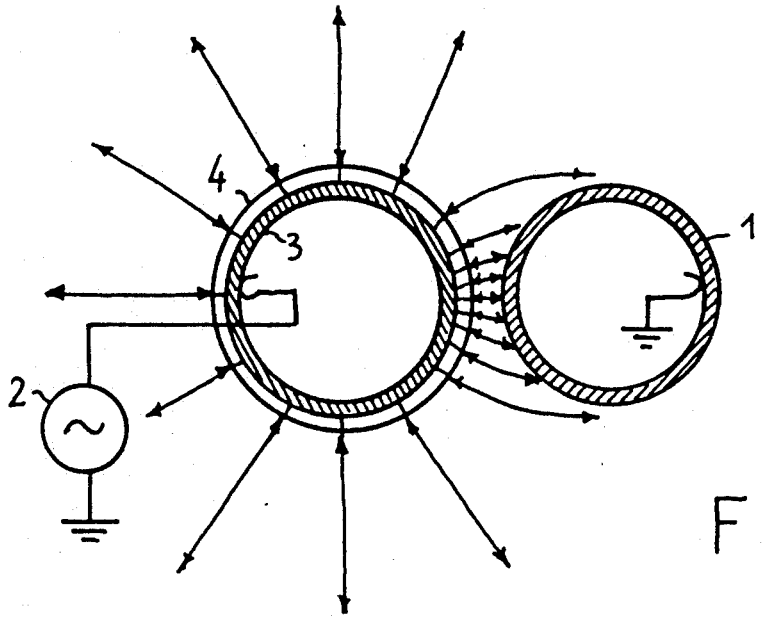
FIG. 2

ELECTROPHOTOGRAPHIC DEVELOPING APPARATUS HAVING IMAGE QUALITY IMPROVING DEVICES

FIELD OF THE INVENTION

The present invention relates to a developing apparatus for use in electrophotographic copying machines and electrophotographic printers.

BACKGROUND OF THE INVENTION

It is known that in copying and printing machines of the electrophotographic type, an electrostatic latent image holder, generally consisting of a conductive cylinder coated with a layer of photoconductive material, is juxtaposed, along a generatrix of the cylinder, to a developing material carrier which is also generally cylindrically-shaped. The two cylinders may be in contact or spaced apart with a predetermined gap therebetween, generally on the order of 50 to 500 microns. The two cylinders usually rotate in the opposite direction with the same peripheral speed. In some implementations, however, they rotate with differing peripheral speeds and/or in the same direction.

A thin layer of powder developing material, known as "toner", suitably electrized by triboelectric effect, is formed on the surface of the developing material carrier, hereinafter designated as the developing roller. The toner, which generically has magnetic properties, adheres to the developing roller due to magnetic fields suitably generated on the developing roller surface and to Van Der Waal forces which act between the toner granules and the developing roller in spite of an electrical potential applied to the developing roller relative to ground, of the same polarity as the electrical charge acquired by the toner due to the triboelectric effect. This charge is generally negative.

The conductive cylinder of the latent image carrier (which in the following will be designated as OPC due to the extensive use of Organic Photo Conductive materials for its implementation) is generally grounded. An electrical charge, generally negative, is formed on the OPC surface by means of an electrostatic charge generator. This electrical charge lowers the surface potential to a predetermined value, for example −680 v referenced to ground.

The OPC generatrixes, duly electrized, reach, due to the OPC rotation, an exposing station where the OPC is selectively exposed to an electromagnetic radiation. In the exposed zones, the photoconductive material loses its electrical charge, and its electrical potential drops virtually to 0 v (in practice, to about 50 v). The several OPC generatrixes so exposed then reach the developing station where the toner particles, negatively charged and immersed in the electrical field formed by the differing potential of the developing roller and the OPC, are attracted onto the OPC in the OPC zones where it has been discharged to 0 v.

In the zones where the OPC remains charged (−680 v) the electrical field opposes the toner migration from the developing roller. Continuing its rotation, the OPC carries the toner particles, selectively located on its surface, into a transfer zone or transfer station where the OPC contacts, along one of its generatrixes, a printing support (generally a paper sheet) which is fed with the same speed as the OPC.

In the transfer station, the printing support is interposed between OPC and an electrostatic charge generator which charges the printing support with a positive charge. The positive polarization is sufficient to attract the toner from the OPC to the printing support where the toner adheres and is subsequently permanently fixed in a fixing station.

This process, conceptually very simple, does not produce perfect results in practice corresponding to the desired ones. The toner transfer from the developing roller to the OPC occurs not only in the zones where it is required, but to some extent also in the zones where it is not desired providing a "background" effect which hampers the quality of the images which can be obtained. This is due both to the impossibility of obtaining a sharp change of the electrical field at the borders of the latent image and to the impossibility of uniformly charging the several toner particles. It must be assumed that, statistically, a certain number of particles are weakly charged, not charged at all or electrically charged with the opposing polarity.

The adherence of electrically neutral particles to the OPC rather than to the toner carrying drum cannot be controlled by means of electrical fields and escapes control. Even in case of weakly charged particles, the control action exerted by the electrical fields is to some extent inadequate.

To overcome these limitations, it has been proposed (and described in several patents among which U.S. Pat. No. 3,866,574 is representative) to apply an a-c voltage to the developing roller, in addition to the biasing d-c voltage, in order to generate a pulsing electrical field between the OPC and the developing roller. Several frequencies and amplitudes have been proposed to achieve some enhancement of the printed images in terms of contrast, resolution and background reduction.

Basically two explanations have been given for these results. First, the pulsing electrical field should cause a vibration of the toner particles which makes easier their detachment from the developing roller even if the particles are weakly charged. Second, the pulsing field (at the extreme an alternating field) should cause a particle rebound from the OPC to the developing roller with the consequence of collisions among particles and detaching of a greater amount of toner from the developing roller.

Whatever the explanation may be, the results which have been achieved are limited. The present invention overcomes these limitations and provides a developing apparatus in which the background effect is minimized and the image resolution is enhanced to an extreme level. In addition, the efficiency of the process is improved, and the toner amount which is wasted is reduced to a minimum.

SUMMARY OF THE INVENTION

These advantages are achieved with an electrophotographic developing apparatus in which an alternating voltage is applied between ground and the conductive cylinder of the OPC instead of applying it between ground and developing roller.

This arrangement at first would not seem to change, in a relevant way, the performance of the apparatus, relative to that of the prior art, because the electrical field which is produced between the OPC and the developing roller (if locally considered as flat plates of a capacitor) only depends on the voltage existing between the two elements. In fact, however, this arrangement changes the distribution of the electrical field around the whole OPC cylinder, subjecting the toner particles laid down thereon to pulsed forces of attractive and repulsive nature which in the unexposed zones have an intensity sufficing to enable the migration of the charged particles from the unexposed zones to the exposed ones. This migration is caused by the attractive component of the electrical field, tangent to the OPC surface, resulting from the differing status of electrical surface bias.

Since the background effect is nearly completely avoided, it must be concluded that the neutral particle are dielectrically biased by the pulsing electrical field and, even if subjected to an attractive force, are somehow allowed to migrate to the zone having a higher potential. Some induced triboelectric effect cannot be excluded.

A further advantage occurs in the transfer zone where the electrical field locally reaches a high strength and where the printing support, positively biased, is subjected to a pulsing force which causes its vibration. This vibration, perceivable as noise, must produce some triboelectric effect which electrizes uncharged particles, too. It also produces some mechanical capture effect, in addition to the electrical one, so that all the toner particles which are present on the exposed OPC zones are transferred onto the printing support.

DESCRIPTION OF THE DRAWING

The features and the advantages of the invention will be understood more clearly from the following description of a preferred embodiment of the invention and from the accompanying drawing where:

FIG. 1 shows in qualitative way the electrical field generated by a developing roller biased by an alternating voltage according to the prior art;

FIG. 2 shows in qualitative way the electrical field generated by an OPC drum biased by an alternating voltage applied between the OPC and ground, in accordance with the present invention;

DETAILED DESCRIPTION OF THE PREFERRED EMBODIMENT(S)

Figure 3:
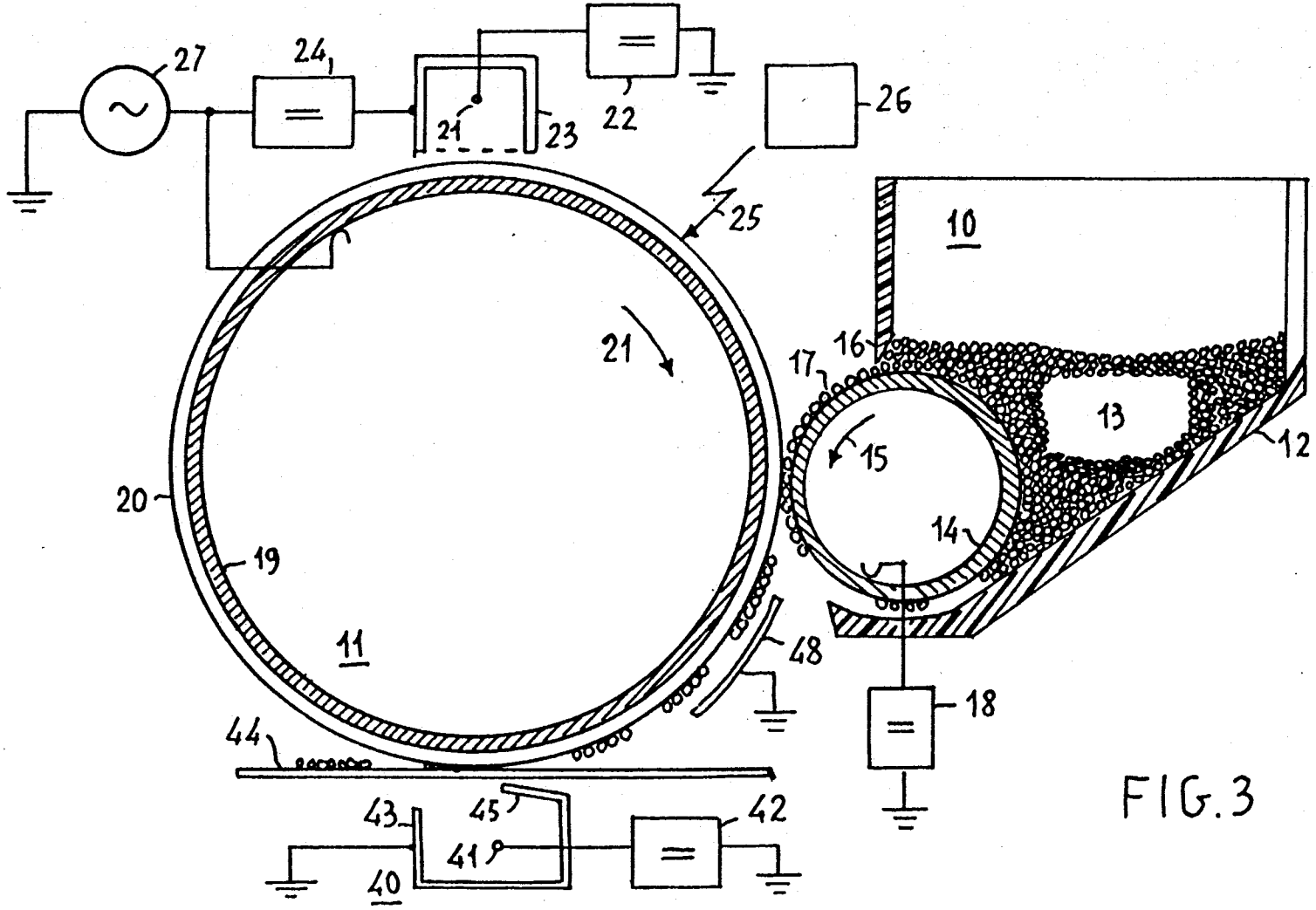
FIG. 3 shows schematically a preferred form of embodiment for the developing apparatus of the invention.

For a better understanding of the invention, FIG. 1 shows in qualitative way the electrical field generated by a developing roller 1, biased by an alternating voltage (produced by generator 2) applied according to the prior art between developing roller 1 and ground when the conductive cylinder 3 of the OPC 4 is grounded. In the zone where the two cylinders are juxtaposed, a strong alternating electrical field is established between the two elements. On the remainder of the developing roller surface, a less strong, radial alternating electrical field is established.

The remainder of the OPC surface is immersed in an electrical field directed tangentially to the OPC surface (zones 5, 6) or null (zone 7) owing to the shielding effect of the OPC itself. This is the electrical field distribution which occurs, "grosso modo", in the prior art developing apparatus.

FIG. 2 shows in a qualitative way the electrical field generated by the conductive cylinder 3 of the OPC 4 when it is biased according to the invention by an alternating voltage (produced by generator 2) applied between the cylinder 3 and ground with the developing roller 1 is grounded. In the zone where the two cylinders are juxtaposed, a strong alternating electrical field is established, similar to the one shown FIG. 1, but having a more radial distribution relative to the OPC axis than in the case of the apparatus of FIG. 1. The remainder of the OPC surface is immersed in an electrical field which is much less strong, but still radial relative to the OPC axis. This is the electrical field distribution which occurs, "grosso modo", in the developing apparatus of the invention.

The differences between the electrical fields which are generated in the two cases (differences which are simply neglected in the common way of conceiving the electrical field generated between the two "plates" as the result of the voltage applied between them and hence independent of the potential of the two plates as to ground and the surrounding environment) seem to be the only possible explanation for the improved results achieved by the present invention.

FIG. 3 shows schematically a preferred embodiment for the apparatus of the invention. In FIG. 3, a developing unit 10 is juxtaposed to an OPC device 11 in the form of a rotating drum. The developing unit 10 includes a toner reservoir 12 for toner 13 and a developing roller 14 of conductive material. The developing roller rotates in the direction of arrow 15 at a predetermined peripheral speed on the order of 5 cm/sec. A thin toner layer 17, having a thickness on the order of 50 microns imposed by a control blade 16, is drawn from reservoir 12, adheres to the surface of roller 14 and is brought towards the developing zone. The adherence of the toner particles to the roller is assured by Van Der Waal forces and, in the case of magnetic toner, by magnetic fields suitably generated by conventional means. The toner which adheres to roller 14 is negatively charged by triboelectric effect. The developing roller 14 is electrically biased at a negative potential on the order of −300 v to −500 v, referenced to ground, by a d-c voltage generator 18 connected between the roller 14 and ground.

The OPC device 11 includes a cylinder 19, made from a conductive material, coated with a layer 20 of photoconductive material and which rotates in the direction of arrow 21. At the developing zone or station, the OPC surface is spaced apart form the roller 14 surface by a gap having the same order of magnitude as the toner layer 17 thickness or slightly greater. A corotron located upstream of the developing station and consisting of an ionization wire 21 (negatively biased at a level on the order of −2 kv to −5 kv by means of a voltage generator 22) and a grid shield 23 uniformly negatively charges the surface of the photoconductive layer. The electrical potential of the surface charge is controlled by a d-c voltage generator 24, which applies a voltage in the order of −700 v between the grid shield 23 and the conductive cylinder 19 of the OPC device.

In this way, the OPC surface is charged at a potential of −700 v relative to the potential of cylinder 19. The thus charged OPC surface is selectively exposed to an electromagnetic radiation 25, controlled by an image generator 26, at an exposure station located downstream of the corotron and upstream of the developing station. In the exposed zones, the photoconductive material allows the electrical charges at the surface to discharge on the conductive cylinder 19. In these zones the OPC surface takes a substantially null potential as to the potential of cylinder 19.

According to the invention, the cylinder 19 is electrically biased by an a-c generator 27, to on the order of 200 v–500 v peak, which is connected between cylinder 19 and ground. The frequency of the a-c voltage may be selected within very broad limits, with a lower limit which essentially depends on the developing speed, say the peripheral speed of the OPC. The upper frequency limit seems to be related to the size and the mass of the toner particles in inverse relation. In practice, with a toner formed by particles having a size on the order of 10 microns and a toner bulk density (before powdering of the material) of 0.6 $Kg/dm^3$, all frequencies between 100 and 1500 Hz provide satisfactory results.

Figure 4:
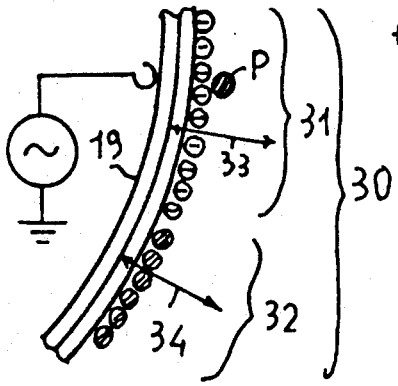
FIG. 4 shows the electrical state of a portion of the OPC drum in the apparatus of FIG. 3.
Figure 5:
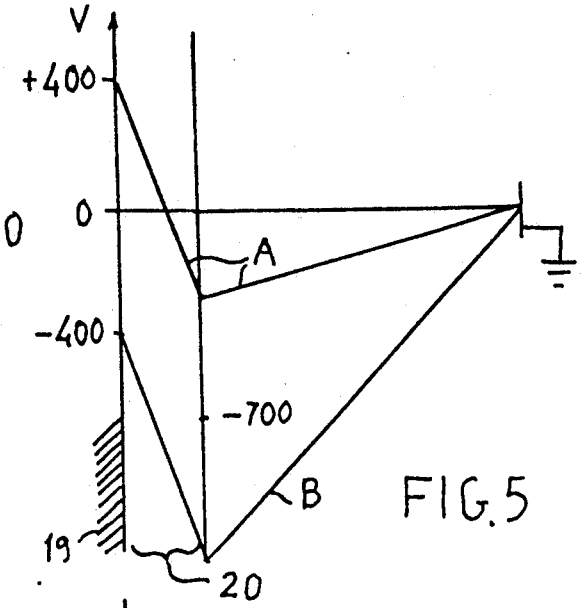
FIGS. 5 and 6 show the electrical field acting in two zones, respectively unexposed and exposed, of the OPC portion shown in FIG. 4.
Figure 6:
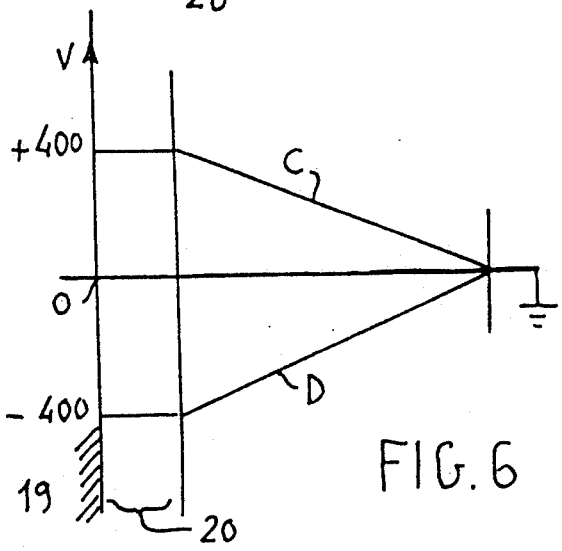

The surprising and unexpected results which are obtained by this biasing arrangement may be explained with reference to FIGS. 4, 5 and 6 which show the electrical state of an OPC portion downstream of the developing station (at the developing station, the effect of the alternating OPC biasing is substantially the same as an alternating biasing of the developing roller and is not considered here). FIG. 4 shows a portion 30 of the OPC which comprises an unexposed zone 31, hence with a negative surface charge (of −700 v relative to the conductive cylinder 19), and an exposed zone 32 which has been discharged and on which toner particles reside. For the purpose of simplification, it may be assumed that the negative charge of the toner particles does not change in a substantive way the electrical fields generated by the external biasing and by the OPC polarization. With this assumption and using the principle of the cumulation of effects, it is possible to consider in a qualitative way the electrical fields which affect the OPC portion 30 and its surface.

An a-c bias of 400 v peak applied to the conductive cylinder 19 generates a radial field represented by arrows 33, 34. In the zone 31, the radial field is overlapped with the field generated by the OPC polarization charges (−700 v d-c) so that the potential of the space surrounding zone 31 may be represented in its extreme conditions by diagrams A and B of FIG. 5. Similarly, the potential of the space surrounding zone 32 is represented in its extreme conditions by diagrams C and D of FIG. 6.

A representative toner particle P (FIG. 4), negatively charged and located at the surface of zone 31, is therefore subjected to a repulsive force of variable amplitude which tends to push it away from the surface in opposition to the non-electrostatic forces (Van Der Waal forces) which retain it at the surface. This repulsive force provides a relative mobility to the particle. In zones 31 and 32, a tangential electrical field (due to the presence of electrical charge in zone 31 and to the missing of electrical charge in zone 32) overlaps with the radial field generated by voltage generator 27 and by the charges in zone 31. Therefore, a tangential force acts on particle P in addition to the repulsive one, and this tangential force tends to pull particle P towards zone 32.

Based on experimental results, it must be concluded that, even if the repulsive force is modest, its repeated application on a particle such as P (for the entire time period required by OPC portion 30 to move from the developing station to the transfer station) allows particle P to move towards zone 32 owing to the tangential force acting thereon. If particle P is electrically neutral, the following considerations may be developed. When particle P is immersed in an electrical field, it is subjected to dielectric polarization, hence to a radial pulsing force. In view of the experimental results, it must be concluded that the continued and repeated application of a pulsed force causes a mechanical oscillation of the particle on the OPC surface. This oscillation induces, to some extent, a triboelectric effect so that the particle, initially neutral, charges negatively and behaves as already described. As a consequence, most of the particles, which are transferred by the developing roller onto the OPC surface in unexposed zones, migrate to the exposed zones, particularly if they are close to the borders of the exposed zones. Therefore, the development apparatus of the invention achieves highly contrasted images having very well defined edges and a substantive background reduction.

Further advantages are provided by the invention. It has been observed that the electrical a-c biasing of the OPC provides improved performance in terms of toner transfer from the OPC to the printing support. Compared to conventional electrophotographic systems in which some toner always remains on the OPC, all the toner present on the exposed zones of the OPC are transferred to the printing support leaving the OPC perfectly clean.

To explain this result, the transfer mechanism will be briefly explained. With reference again to FIG. 3, the transfer station includes a corotron 40 facing the OPC drum 11. The corotron has an ionizing wire 41, electrically biased at a high positive potential on the order of +3.5 kv by a voltage generator 42, and a grid shield 43 connected to ground. A printing support 44 is brought into contact with the OPC at the transfer station and is fed, interposed between corotron 40 and OPC 11, at a speed equal to the peripheral OPC speed. Corotron 40 diffuses positive electrical charges on the printing support, which is electrized, and it also generates a strong electrical field between the printing support and OPC. This field detaches the negatively charged toner particles from the OPC and attracts them onto the printing support for subsequent fixing in a fixing station.

It is clear that this action is exerted on electrically charged particles, not on the neutral ones. However, the alternating biasing of cylinder 19, as already indicated with reference to FIG. 4, imparts to the neutral particles a dielectric polarization subjecting them to a pulsed attractive force and to oscillations which cause their electrical charging due to triboelectric effect. The phenomenon is intensified in the exposed zones by the presence of contiguous particles, mostly charged and hence subjected to attractive and repulsive forces with consequent relative displacement among charged particles and neutral ones and related friction. The consequence is that, at the transfer zone, all the particles present in the exposed zones of the OPC are electrically charged and subjected to the transfer electrical field.

Figure 7:
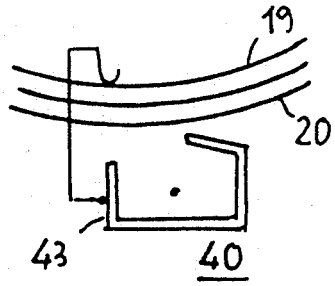
FIGS. 7 and 8 show alternative embodiments for one detail of the apparatus shown in FIG. 3.
Figure 8:
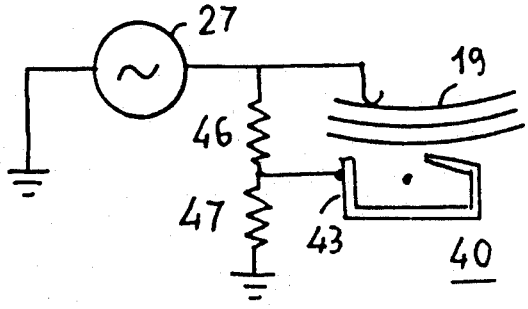

It is further noted that, for the correct guidance of the printing support between the OPC and corotron 40, shield 43 is provided with a conductive guiding blade 45 juxtaposed to the OPC surface at a distance on the order of 2.0–3.0 mm from the OPC at the printing support input and at a distance on the order of 0.5 mm at the output. In this zone, the electrical field generated by the alternating biasing of the OPC is particularly strong, at a level such that the printing support, ionized by charge migration from the zone facing the corotron grid to the zone interposed between OPC and guiding blade, vibrates causing a noise at the frequency of the alternating biasing. In such zone, two effects cumulate each to the other. On one side, the electrical field is so strong that the triboelectric effect and the particle migration are increased. On the other side, the printing support itself exert a mechanical action of variable compression on the toner further facilitating the transfer. The only drawback is noise generation which may be completely avoided by electrically connecting shield 43 to the conductive cylinder 19, as shown in FIG. 7 or limited to a acceptable level by biasing shield 43 with a fraction of the biasing potential of cylinder 19. This potential, relative to ground, may be easily obtained by connecting shield 43 to the intermediate point of a resistive voltage divider 46, 47 connected between the output of generator 27 of FIG. 3 and ground as shown in FIG. 8.

It will be understood by those skilled in that art that a voltage dependent resistor VDR or a zener diode connected between cylinder 19 and shield 43 may be a substitute for such voltage divider. The same arrangements may be used to generate the several biasing voltages required in the apparatus, taken from the voltage generated by one or two voltage generators only (respectively a positive and a negative voltage generator).

Similarly, it is clear that several other changes can be made to the developing apparatus of the invention. Thus, even if the description of the preferred embodiment relates to a latent image carrier (OPC) and a toner carrier both in the form of rotating cylinders, the invention is equally applicable in case one or both of these elements are in some form other than a rotating cylinder such as a movable belt mounted on a rotating drum.

The essential aspect of the invention consists in the generation of a variable electrical field perpendicular to the surface of the latent image carrier, which field acts on a relatively wide area of the carrier situated between the development station and the transfer station. The electrical alternating biasing of cylinder 19 of the OPC is only a feature of a preferred embodiment because it assures the generation of such variable field extending to the whole OPC surface and also to the development station and the fixing station.

It has been already indicated that the electrical field so generated is particularly strong in the development station and in the transfer station. It is weaker in the intermediate zone, but, even in such zone, the field may be strengthened with the consequent possibility of lowering the alternating biasing voltage while still achieving the same results. This strengthening of the electrical alternating field generated by the OPC may be obtained by juxtaposing to the OPC surface a conductive armature 48 located between the development station and the transfer station and electrically grounded as shown in FIG. 3. Such armature is preferably located at a distance from the OPC surface of between 1.0 and 5.0 mm and extends along the OPC surface for an arc having a length between 2.0 and 20.0 mm or more, depending on the peripheral distance between the developing station and the transfer station.

With this approach, it is clearly possible to simply the structure of the developing apparatus by generating a variable electrical field perpendicular to the OPC surface and applying an alternating potential to the conductive armature 48 whilst conductive cylinder 19 of the OPC is grounded. The need for electrical isolation from ground and electrical biasing of a movable element such as the OPC is thus avoided and transferred to the armature 48 which may be a steady element.

What is claimed is:

1. Electrophotographic developing apparatus comprising a carrier of latent image formed on a photoconductive layer superposed to a conductive layer, a carrier of developing material juxtaposed to said latent image carrier at a developing zone for transferring said developing material on said photoconductive layer in a configuration corresponding to said latent image, a transfer station for transferring said developing material from said photoconductive layer to a printing support, juxtaposed to said latent image carrier at said transfer station, said electrophotographic developing apparatus characterized in that it further comprises image quality improving means for developing a periodically variable electrical field, perpendicular to said photoconductive layer, generated around said latent image carrier at said developing zone, said transfer station and therebetween, said image quality improving means including:

a first voltage generator for applying to said developing material carrier a predetermined potential as to ground; and a second voltage generator connected between ground and said conductive layer of said latent image carrier for applying to said conductive layer an alternating potential having a predetermined frequency and amplitude as to ground.

2. The apparatus of claim 1 in which said transfer station comprises an electrostatic charge generator having a discharging electrode and a grid shield, said second voltage generator being further connected between ground and said grid shield.

3. The apparatus of claim 1 in which said predetermined potential is between −200 V and 600 V and said alternating potential has an amplitude comprised between 200 V and 600 V peak and a frequency between 100 Hz and 1500 Hz.

4. The apparatus of claim 1 comprising a conductive armature juxtaposed to said latent image carrier in a zone of said carrier extending between said developing zone and said transfer station at a distance comprised between 2 mm and 5 mm, said conductive armature being connected to ground.

5. The apparatus of claim 1 in which said transfer station comprises an electrostatic charge generator having a discharging electrode and a grid shield, said apparatus further comprising second means for applying to said grid shield a fraction of said alternating potential as to ground.

* * * * *